US008584410B2

(12) United States Patent
Furgerson et al.

(10) Patent No.: US 8,584,410 B2
(45) Date of Patent: Nov. 19, 2013

(54) FIXED FRAME WINDOW OR DOOR SYSTEM

(75) Inventors: David Furgerson, Sammamish, WA (US); Julian Giggs, Hillsdale, MI (US); James Potthast, Tecumseh, MI (US); Geraint Krumpe, Chicago, IL (US); Wayne Philip Baker, Warwickshire (GB)

(73) Assignee: Milgard Manufacturing Incorporated, Tacoma, WA (US)

( * ) Notice: Subject to any disclaimer, the term of this patent is extended or adjusted under 35 U.S.C. 154(b) by 354 days.

(21) Appl. No.: 12/758,386

(22) Filed: Apr. 12, 2010

(65) Prior Publication Data

US 2010/0269432 A1 Oct. 28, 2010

Related U.S. Application Data

(60) Provisional application No. 61/171,925, filed on Apr. 23, 2009.

(51) Int. Cl.
*E06B 1/26* (2006.01)

(52) U.S. Cl.
CPC ..... *E06B 1/26* (2013.01)
USPC ..... 52/209; 52/211; 52/717.01; 52/718.08; 49/504

(58) Field of Classification Search
USPC ..... 52/209, 211, 213–217, 717.01, 52/718.04–708.06, 745.15, 745.16
See application file for complete search history.

(56) References Cited

U.S. PATENT DOCUMENTS

| | | | | |
|---|---|---|---|---|
| 1,672,435 | A | 6/1928 | Sterner et al. | |
| 2,696,280 | A | 9/1946 | Bourne et al. | |
| 2,771,970 | A | 11/1956 | Geyser | |
| 3,443,346 | A * | 5/1969 | Eggert, Jr. | 52/717.01 |
| 3,491,486 | A * | 1/1970 | Caruth | 52/476 |
| 4,115,964 | A | 9/1978 | Montrouil | |
| 4,335,552 | A * | 6/1982 | Blanchett et al. | 52/717.01 |

(Continued)

FOREIGN PATENT DOCUMENTS

| | | |
|---|---|---|
| EP | 0202510 | 11/1986 |
| EP | 1 300 536 A2 | 4/2003 |

(Continued)

OTHER PUBLICATIONS

Partial European Search Report Jul. 2, 2012 Application No. 10160930.0 Patent No. 1255/2246512 Applicant: Milgard Manufacturing Inc.

EP Trans. and Search Report Date: Dec. 13, 2012 Application No: 10160930.0-1255/2246512 Applicant: Milgard Manufacturing Inc. Ref.: P335744EP/DC.

*Primary Examiner* — Mark Wendell
*Assistant Examiner* — Matthew J Smith
(74) *Attorney, Agent, or Firm* — Reising Ethington PC

(57) ABSTRACT

A window or door system includes a frame adapted to be received within a window or door opening. A window or door unit is disposed on the frame, and a retainer is received by interference fit on either the frame or the window or door unit. The retainer has a portion that extends to engage the other of the frame and window or door unit, and to hold the window or door unit on the frame. The frame can be rectangular, for example, and the retainer may be linear extending along at least one edge of the frame. The frame can include an outwardly opening slot, and the retainer may be received by snap fit in the slot.

34 Claims, 21 Drawing Sheets

(56) References Cited

U.S. PATENT DOCUMENTS

| | | | | | |
|---|---|---|---|---|---|
| 4,407,100 | A | * | 10/1983 | Huelsekopf | 52/204.54 |
| 4,831,781 | A | | 5/1989 | Morton | |
| 4,999,958 | A | * | 3/1991 | Harrison | 52/214 |
| 5,119,609 | A | * | 6/1992 | Tait et al. | 52/213 |
| D336,962 | S | | 6/1993 | Cole | |
| D363,355 | S | | 10/1995 | Cole | |
| 5,557,894 | A | | 9/1996 | Card | |
| 6,807,778 | B2 | | 10/2004 | Engebretson | |
| 7,114,299 | B2 | | 10/2006 | Ringness | |
| 2008/0271394 | A1 | | 11/2008 | Hand et al. | |

FOREIGN PATENT DOCUMENTS

| | | | |
|---|---|---|---|
| EP | 1300536 | A2 | 4/2003 |
| EP | 1 300 536 | A3 | 2/2004 |
| GB | 1508582 | | 4/1978 |
| GB | 2 150 187 | A | 6/1985 |
| GB | 2 252 586 | A | 8/1992 |
| GB | 2 290 573 | A | 1/1996 |
| GB | 2 425 562 | A | 11/2006 |
| WO | WO 03/076741 | | 9/2003 |

* cited by examiner

FIXED FRAME WINDOW OR DOOR SYSTEM

This application claims priority from U.S. application 61/171,925 filed Apr. 23, 2009.

The present disclosure relates to a system adapted to facilitate installation of a window or door into a structure under construction.

BACKGROUND AND SUMMARY OF THE DISCLOSURE

Installation of window or door systems into buildings under construction, for example, typically involves installation of the windows or doors as complete assemblies at an early stage of construction. The window or door itself is then highly susceptible to damage during subsequent construction-related activities. A general object of the present disclosure is to provide a window or door system that includes a frame adapted for installation at an early stage of construction so that interior and exterior wall features can be installed around the frame, and in which the frame is adapted subsequently to receive and hold a window or door unit at a later stage of construction during which the window or door is less susceptible to damage.

The present disclosure embodies a number of aspects that can be implemented separately from or in combination with each other.

A window or door system in accordance with one aspect of the present disclosure includes a frame adapted to be received within a window or door opening. A window or door unit is disposed on the frame, and a retainer is received by interference fit on either the frame or the window or door unit. The retainer has a portion that extends to engage the other of the frame and window or door unit, and to hold the window or door unit on the frame. The frame can be rectangular, for example, and the retainer can be linear extending along at least one edge of the frame. The frame can include an outwardly opening slot, and the retainer can be received by snap fit in the slot.

A window or door system in accordance with the present disclosure can be received, for example, in a building wall that separates the interior from the exterior of the building. The window system alternatively can be installed in a door. The window or door system can be installed in a wall that separates interior areas of a building. The window or door unit itself can be of any suitable type, such as a window assembly having one or more fixed and/or operable (movable) sashes. The window or door system could include a sliding window or door unit. The window or door unit could include or even consist of a screen having a rim suitable for mounting on the frame by means of the retainer. Thus, the terms "window unit" and "door unit" must be read to include these and other suitable types of units. The retainer can be of any suitable type that is mounted by interference fit. The term "interference fit" includes, but is not limited to, snap fit and press fit.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
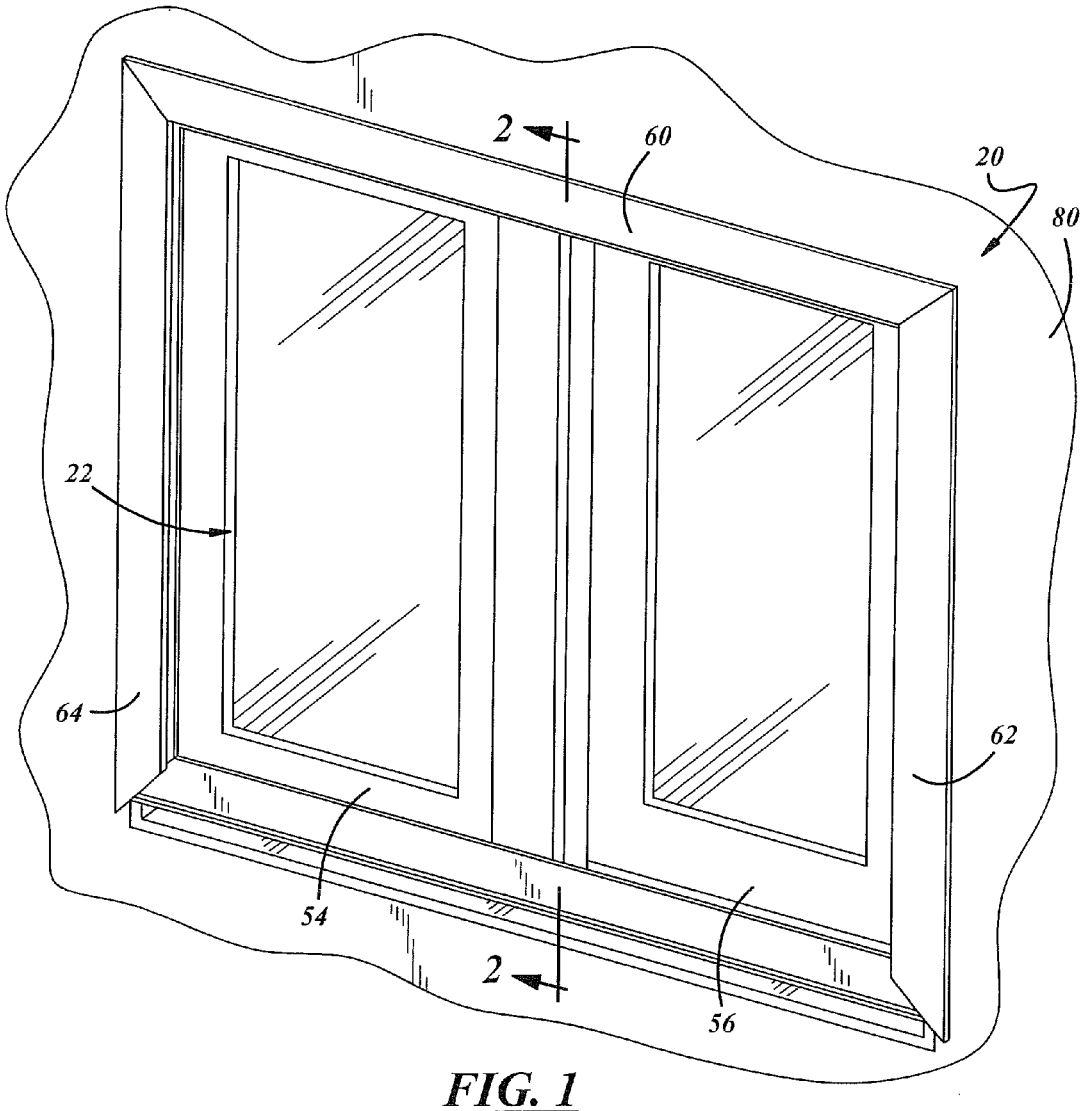
FIG. 1 is a fragmentary exterior perspective view of a window system in accordance with one exemplary embodiment of the present disclosure.
Figure 2:
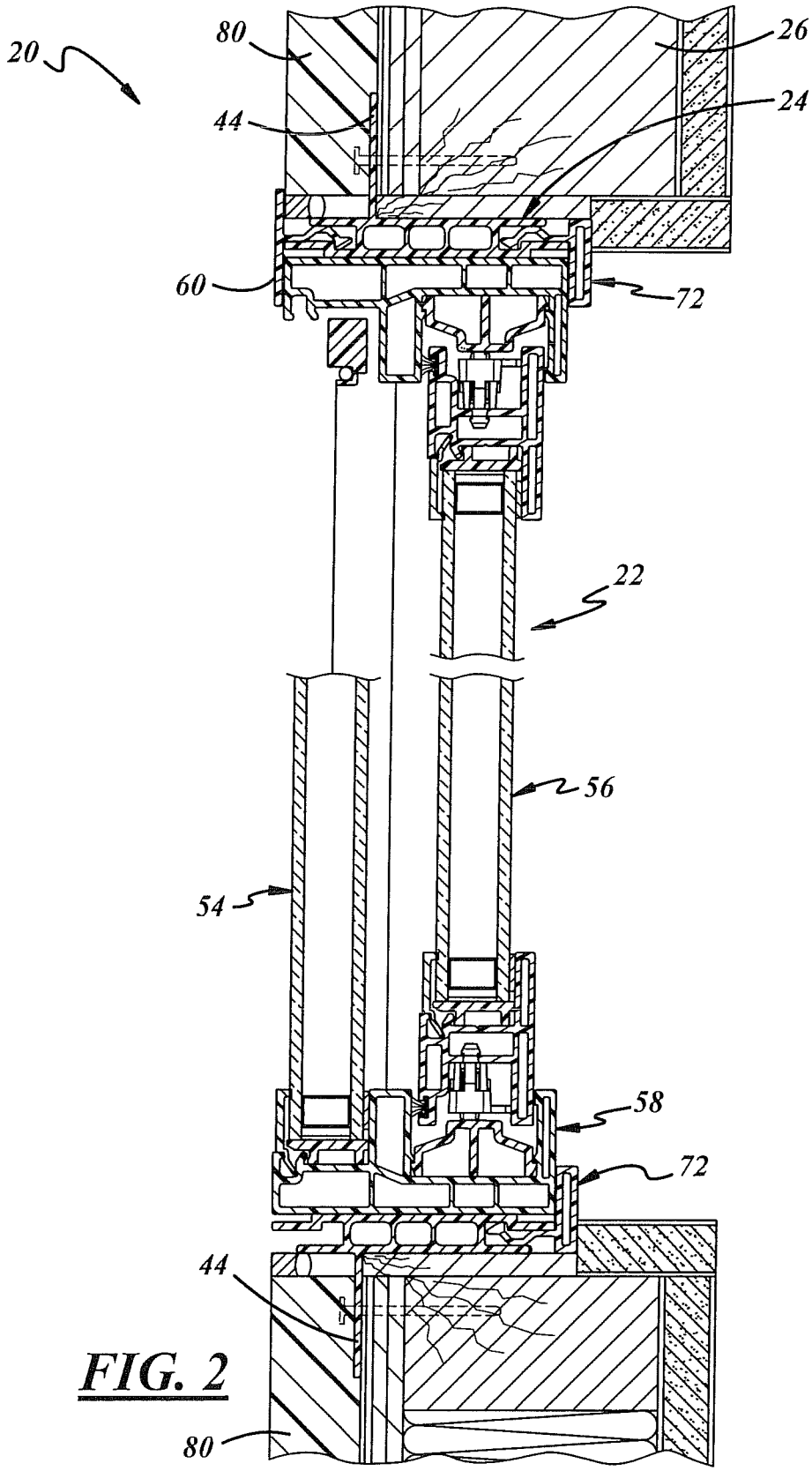
FIG. 2 is a fragmentary sectional view taken substantially along the line 2-2 in FIG. 1.
Figure 4:
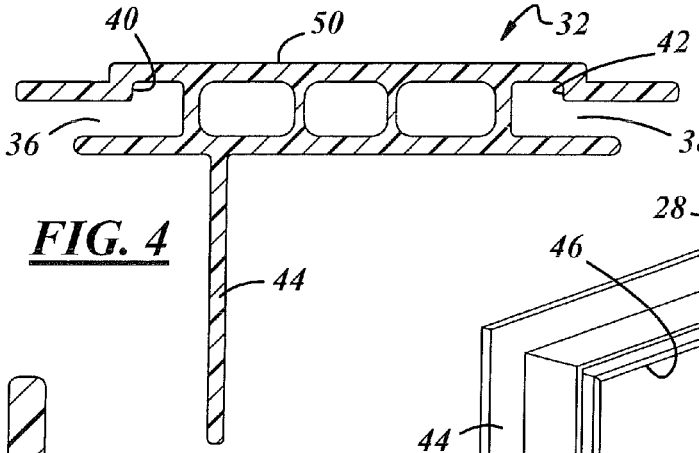
FIG. 4 is a sectional view taken substantially along the line 4-4 in FIG. 3.
Figure 3:
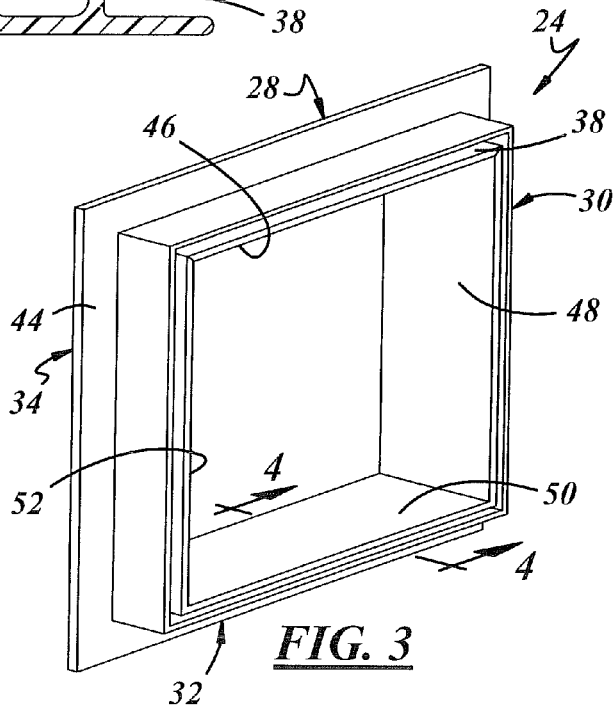
FIG. 3 is a perspective view of the frame in the window system of FIGS. 1 and 2.

FIGS. 1 and 2 illustrate a window system 20 in accordance with an exemplary embodiment of the present disclosure as including a window unit 22 mounted within a frame 24 that is secured to a wall 26. Frame 24 is rectangular in this embodiment, as illustrated in FIG. 3, and can include four rails 28-34 of rigid construction secured end-to-end. Rails 28-34 preferably are of vinyl construction, but could be wood, aluminum, fiberglass or other plastic construction. Rails 28-34 can be joined by welding mitered ends of the rails to each other or by other joining means well known in the art, such as by corner keys. FIG. 4 illustrates an exemplary cross section of rail 32, the four rails preferably having identical cross sections. Rail 32 (and rails 28-30 and 34) can be of extruded plastic construction, such as plastic regrind construction. Rail 32 (and rails 28-30 and 34) has at least one opening such as a laterally outwardly opening slot 36, and can have laterally outwardly opening slots 36, 38 on opposed sides of the rail. Each slot 36, 38 has an associated internal shoulder 40, 42. Rail 32 (and the other frame rails) preferably also has an outwardly extending flange 44 for securing frame 24 to a building wall, as exemplified in FIG. 2.

Frame 24 has an interior window unit opening defined in this exemplary embodiment by four planar surfaces 46, 48, 50, 52 on the insides of respective rails 28-34. Surfaces 46-52 preferably are such that opposed surface pairs 46, 50 and 48, 52 are parallel to each other, and adjacent surface pairs 46 and 48, 48 and 50, 50 and 52, and 52 and 46 are perpendicular to each other. Window unit 22 is slidably received within frame 24 within these planar surfaces. Window unit 22 can include at least one window sash, which can be fixed or movable. In the example of FIG. 2, window unit 22 includes a fixed sash 54 and a movable sash 56. Sashes 54, 56 can be preassembled to a window unit frame 58, which is slidably received within surfaces 46-52 of frame 24. Window unit frame 58 can be, but need not be, of the same material as frame 24. The specific construction of window unit 22 illustrated in FIGS. 1 and 2 (and in FIGS. 8 and 13-19) is exemplary only.

Figure 5:
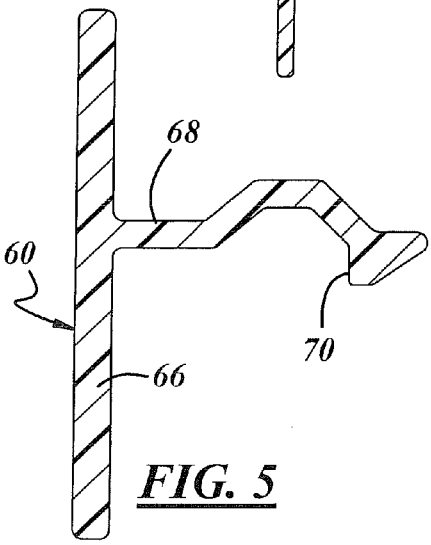
FIG. 5 is an end elevational view of an exterior window unit retainer in the system embodiment of FIGS. 1 and 2.
Figure 6:
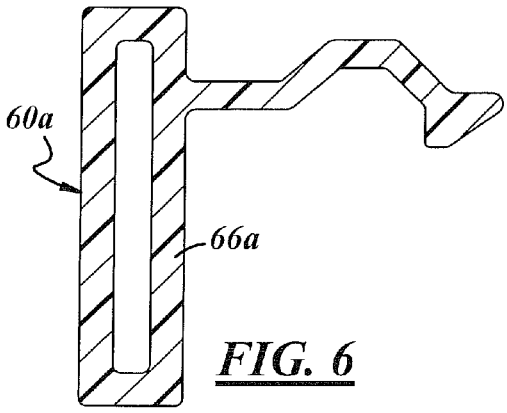
FIG. 6 is an end elevational view of a modification to the retainer of FIG. 5.

An exterior key or retainer 60 is received by interference fit, preferably snap fit, within slot 36 of at least one rail 28-34 of frame 24 for holding window unit 22 within the frame. In the exemplary embodiment of FIGS. 1-5, there are three exterior retainers 60, 62, 64 received in slots 36 of frame rails 28, 30 and 34 respectively. Each retainer 60-64 preferably is in the form of an elongated linear rail having a base 66 and a flange 68 (FIG. 5). Flange 68 preferably terminates in a barb 70 that is adapted to engage shoulder 40 of frame 24 to hold the retainer in position. There is no retainer along bottom rail 32 of frame 24 in the embodiment of FIGS. 1-2 so that water can drain unimpeded from window unit 22. As an alternative, a retainer could be employed along the bottom window edge in FIG. 1 (see FIGS. 17-19 and 23-27), with the retainer having weep openings or other means to facilitate drainage. Retainers 60-64 can be of elongated linear plastic construction such as extruded vinyl construction. Retainers 60, 62, 64 can be joined in a one-piece construction, such as by being welded at mitered ends. FIG. 6 illustrates a modification 60*a* to exterior rail 60 (FIG. 5), in which rail base 66*a* is hollow and rectangular.

Figure 7:
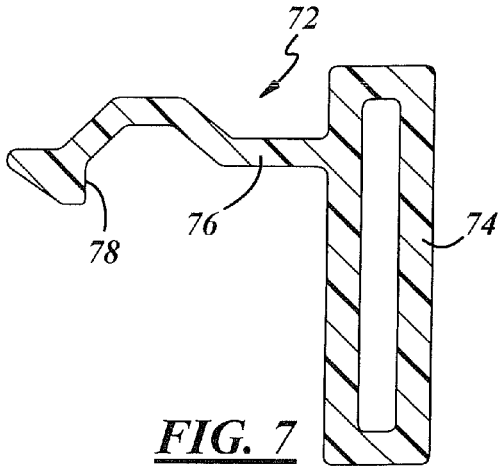
FIG. 7 is an end elevational view of an interior retainer in the exemplary embodiment of FIGS. 1 and 2.

In the embodiment of FIGS. 1-2, there also is an interior retainer 72 (FIG. 7) along the building interior edge of each frame rail to function as an inner or interior stop for installation of window unit 22. Two such interior retainers 72 are illustrated in FIG. 2. Each interior retainer 72 preferably has a body 74 from which a flange 76 extends to terminate in a barb 78 that is received by snap fit over shoulder 42 (FIG. 4) of the associated frame rail. Interior retainers 72 could be integral with frame 24 (see FIG. 19).

Figure 8:
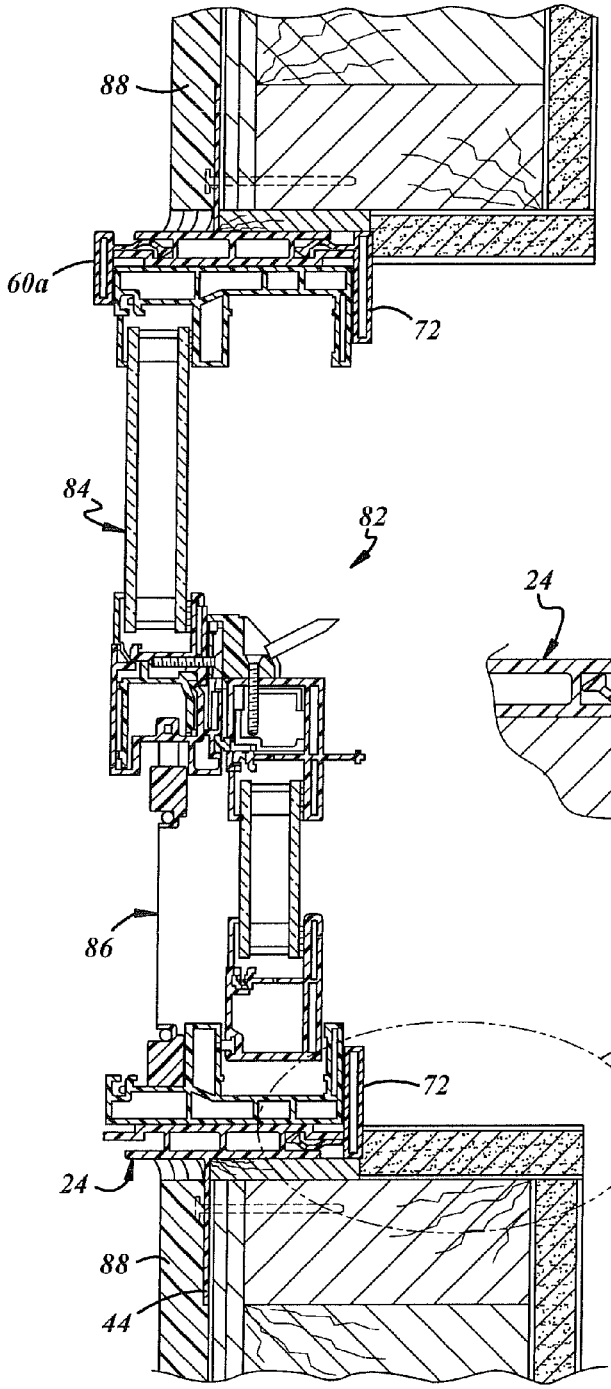
FIG. 8 is a fragmentary sectional view similar to that of FIG. 2 but showing a second exemplary embodiment of the present disclosure.
Figure 9:
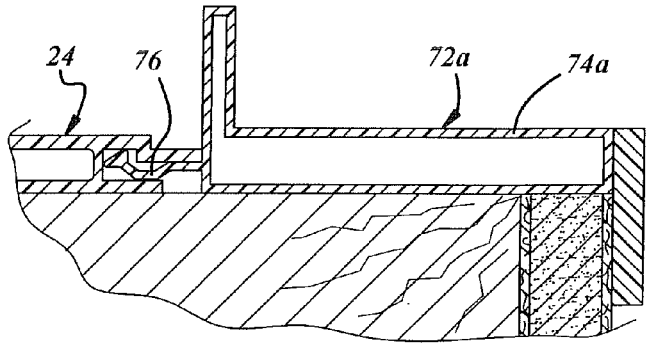
FIG. 9 is a fragmentary sectional view on an enlarged scale of a modification to the portion of FIG. 8 within the area 9.

FIGS. 1 and 2 illustrate an exemplary embodiment of the disclosure installed on a building wall having exterior stucco trim 80 and horizontal sashes 54, 56. FIG. 8 illustrates another exemplary embodiment 82 having vertical sashes 84, 86 and installed on a building wall having exterior siding trim 88. FIG. 9 illustrates a modified interior retainer 72*a* having an elongated body 74*a* to eliminate the need for the drywall sill in FIG. 8.

Figure 10:
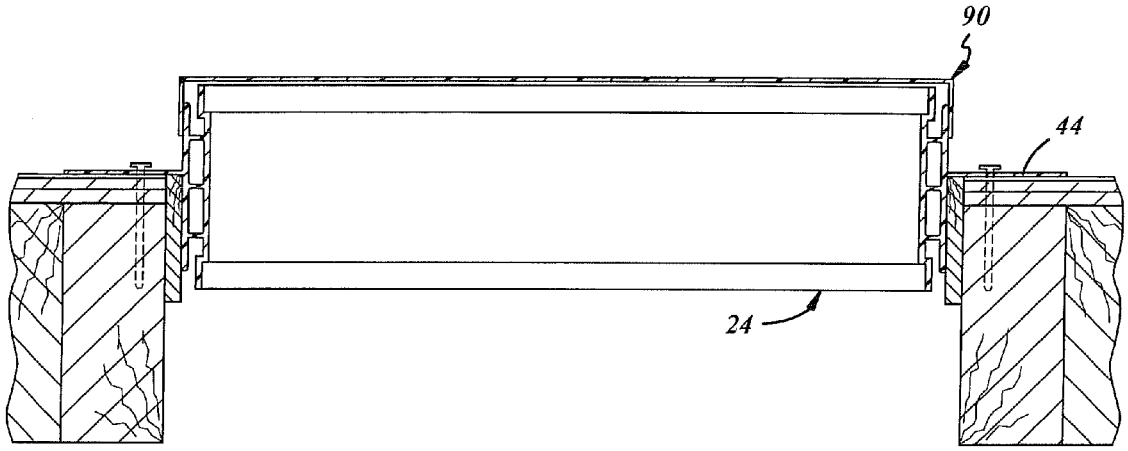
FIG. 10 is a fragmentary horizontal sectional view of a window system in accordance with an exemplary embodiment of the disclosure at an intermediate stage of assembly.

To install a window system in accordance with exemplary embodiments of the present disclosure, a window opening is prepared as illustrated in FIG. 10 and window frame 24 is installed.

Figure 11:
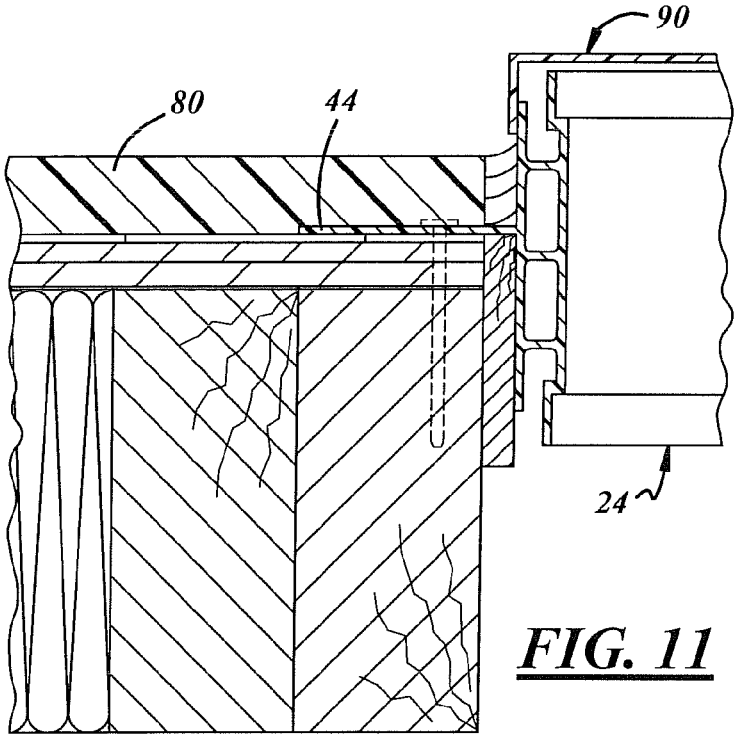
FIGS. 11 and 12 are fragmentary sectional views that illustrate the window system of FIG. 10 at respective later stages of assembly.
Figure 20:
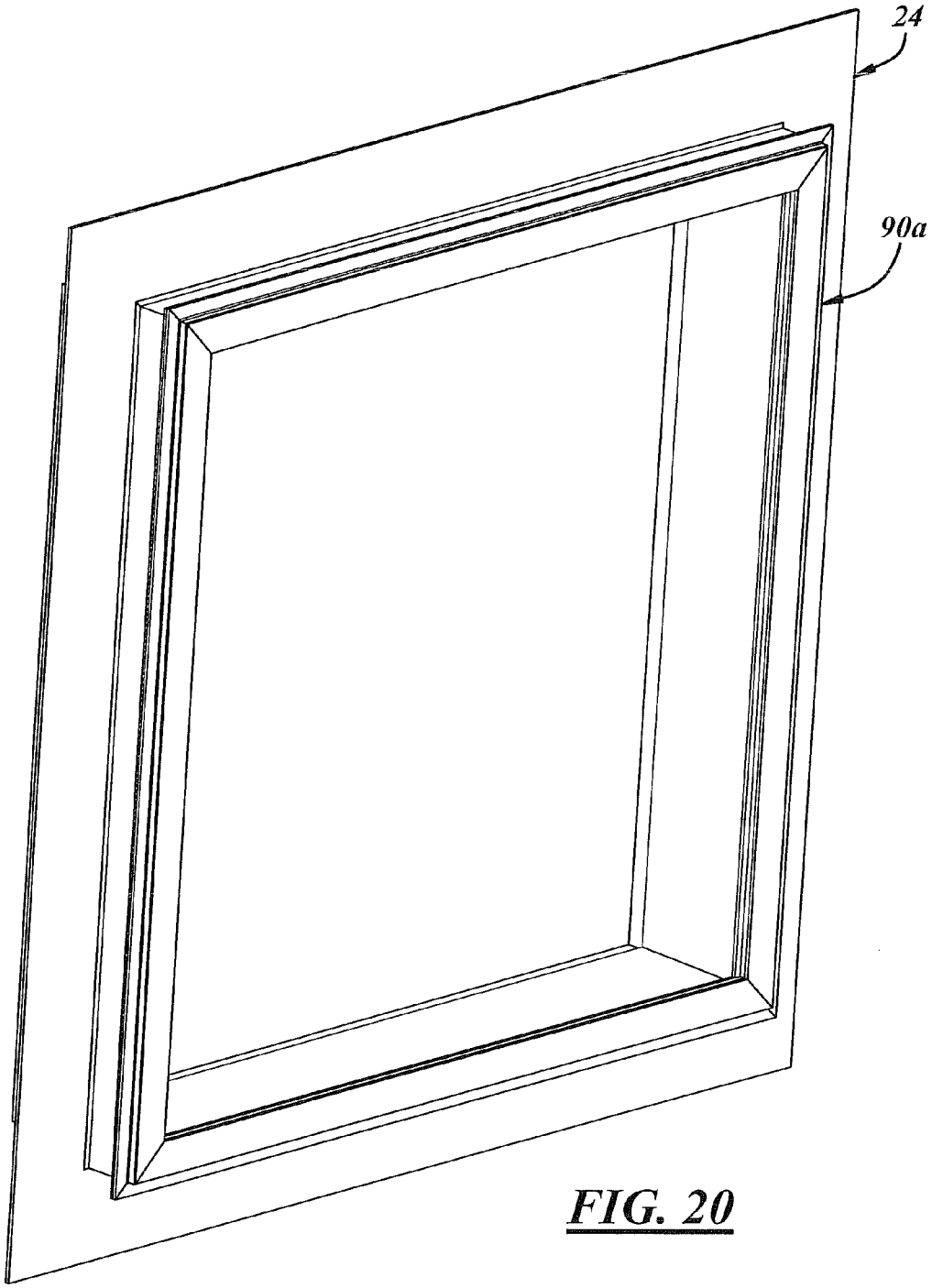
FIG. 20 is a perspective view of a window frame and cover in accordance with a modification to FIG. 10.
Figure 21:
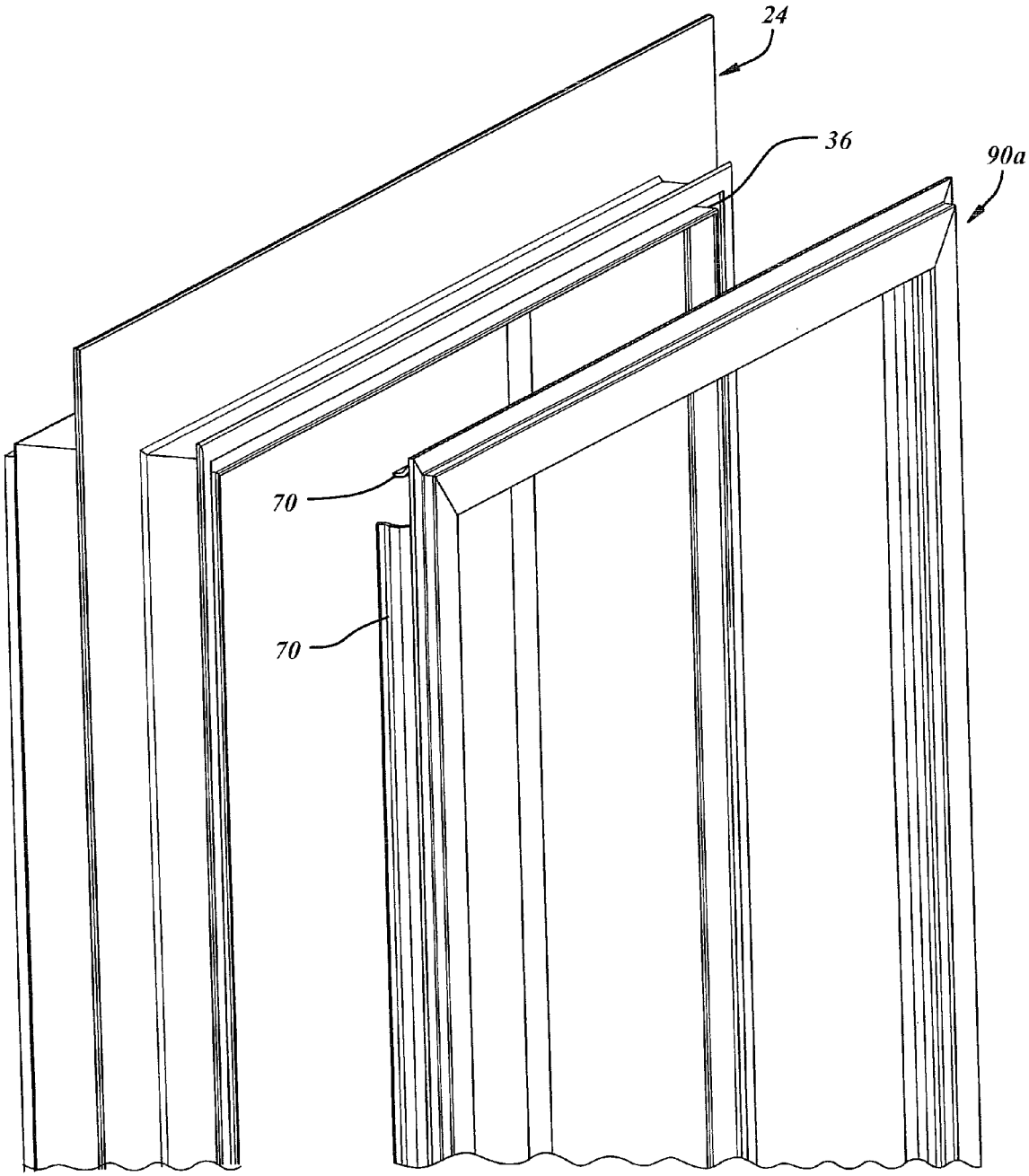
FIG. 21 is a fragmentary exploded perspective view of the frame and cover in FIG. 20.
Figure 22:
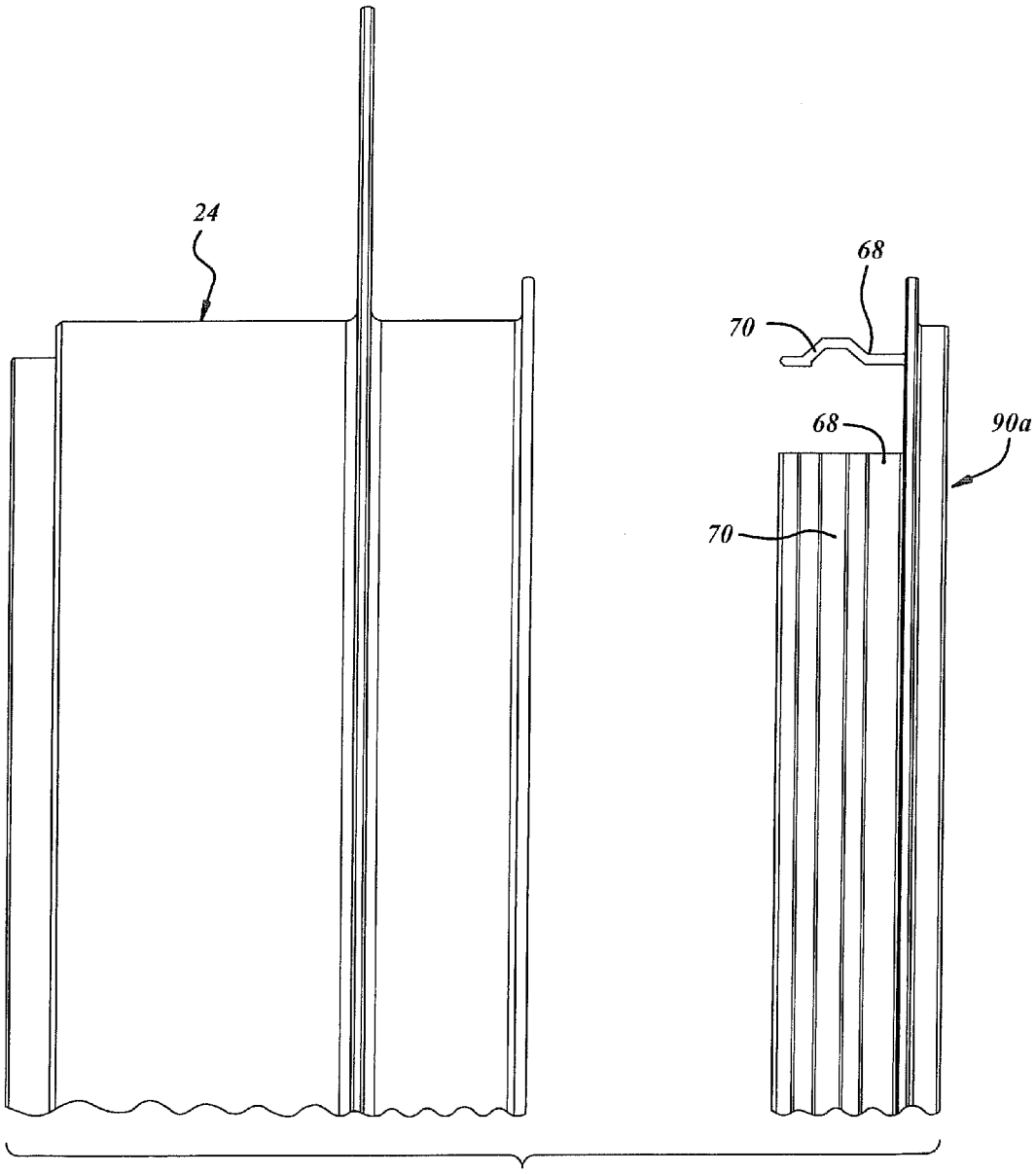
FIG. 22 is a fragmentary elevational view of the frame and cover in FIGS. 20 and 21.

Frame 24 can be packaged with a cover 90, such as a translucent or transparent plastic cover, that is removably received on frame 24 temporarily to close the window opening during further construction-related activities. An alternative cover 90*a*, as shown in FIGS. 20-22, is removably received into at least one outwardly opening slot 36 of frame 24 by means of lineally projecting flange 70. Exterior stucco, vinyl, brick or other suitable exterior trim 80 is installed over the wall around frame 24 as illustrated in FIG. 11. Interior retainers 72 or 72*a* are then installed (FIG. 12) so that interior drywalling can be completed as illustrated in FIGS. 2, 8 and 9. Inasmuch as the interior retainers normally are not removable, these retainers could be fabricated as an integral part of the frame (see FIG. 19). With wall construction thus substantially complete, cover 90 can be removed and window unit 22 or 82 installed by slidable receipt within frame 24. One or more exterior retainers 60 or 60*a* are then installed to hold window unit 22 or 82 firmly in place. The exterior retainers can be removable to facilitate replacement or repair of the window unit.

Figure 13:
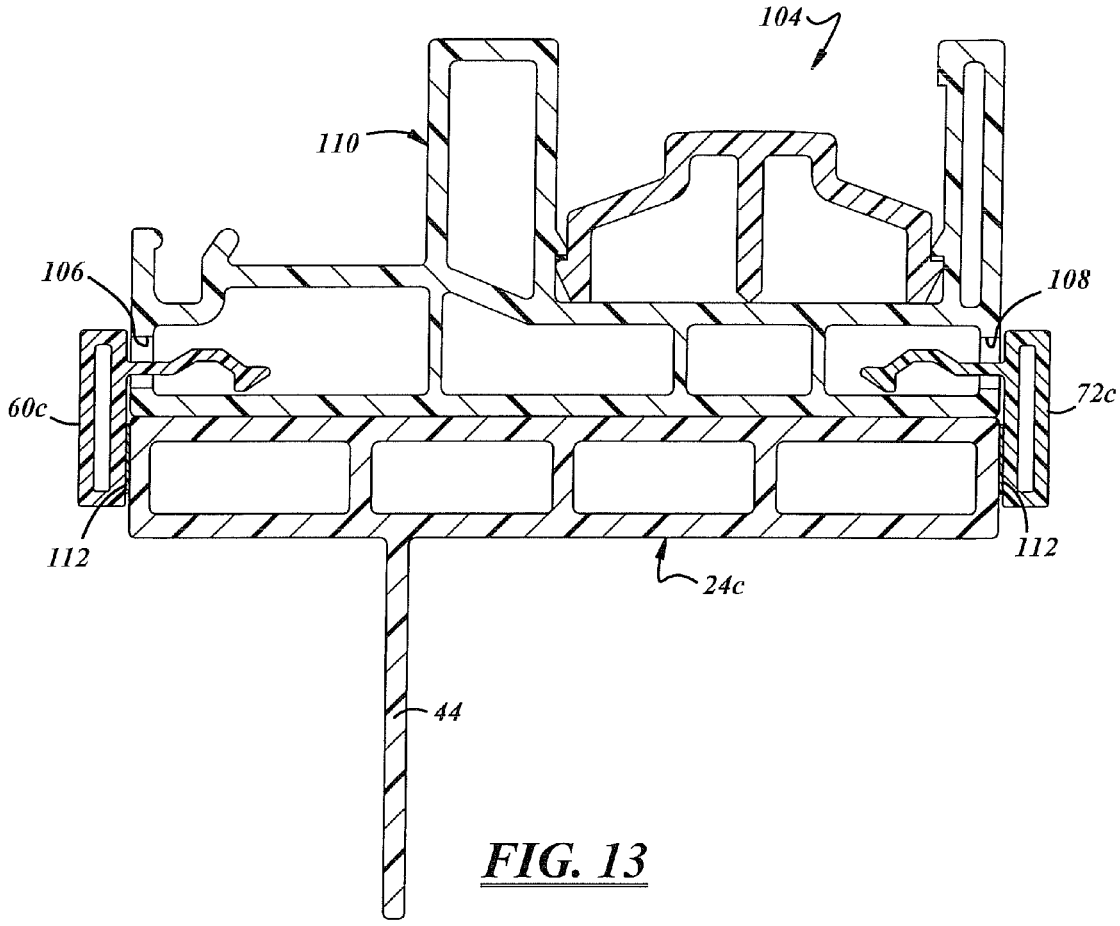
FIG. 13 is a fragmentary sectional view of a window system in accordance with yet another exemplary embodiment of the present disclosure.

FIG. 13 illustrates a window system 104 in which exterior retainers 60*c* and interior retainers 72*c* are received by snap fit within openings 106, 108 in window unit 110. Double-sided structural tape 112 can be disposed between retainers 60*c*, 72*c* and the opposing faces of frame 24*c* to help hold the retainers in place.

Figure 14:
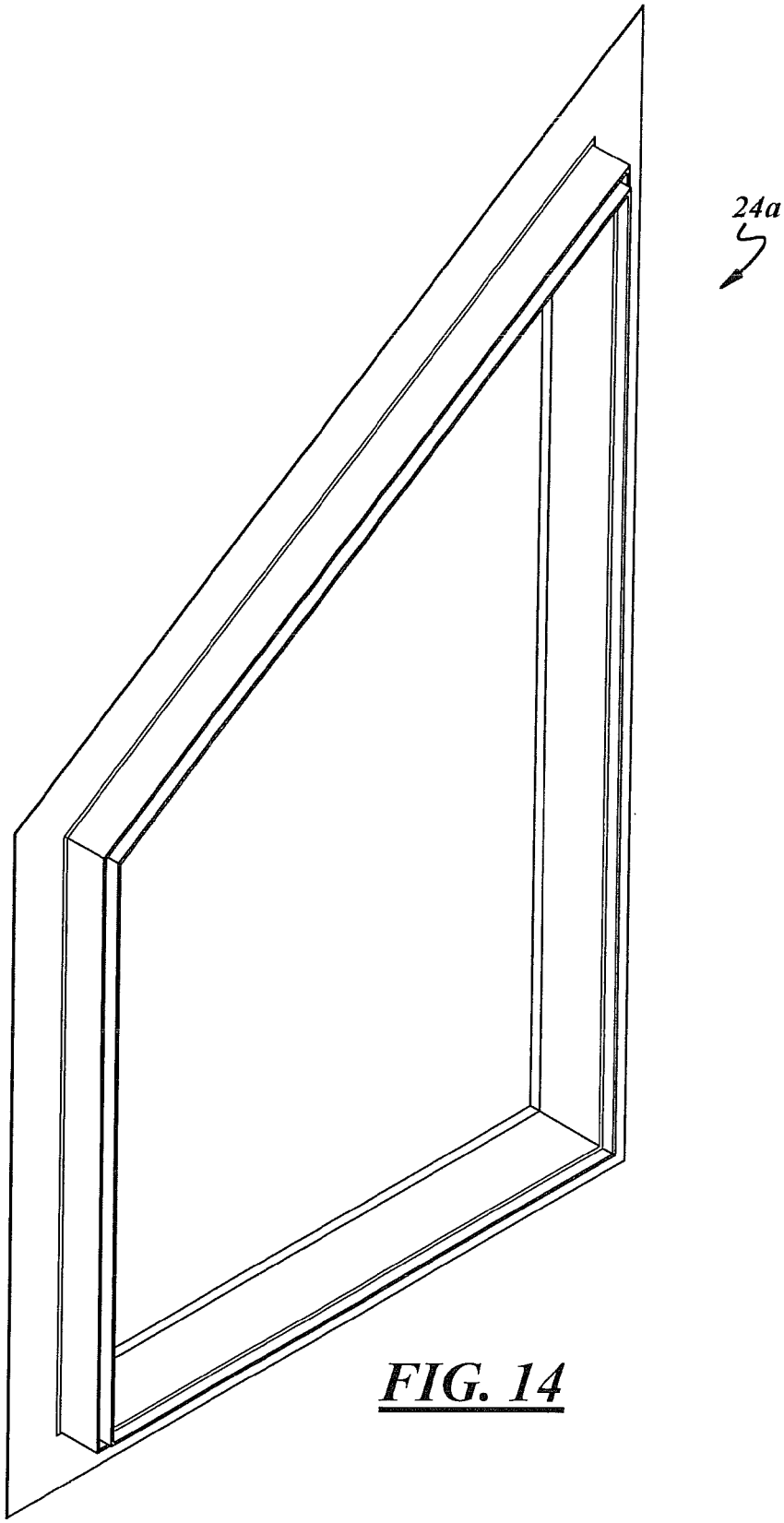
FIGS. 14 and 15 are perspective views of frames in accordance with respective additional exemplary embodiments of the disclosure.
Figure 15:
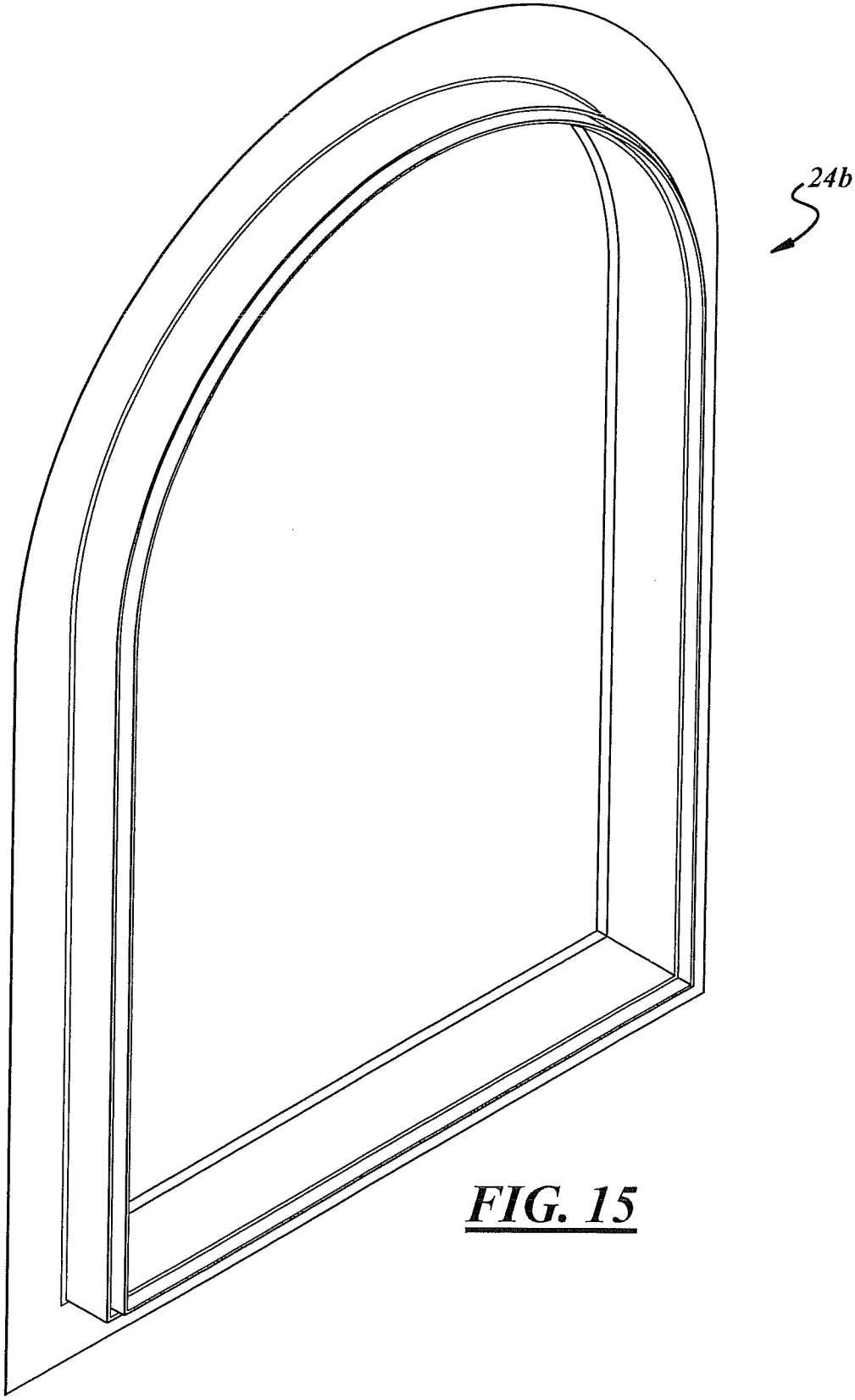

In the exemplary embodiments discussed above, the frame 24 or 24*c* is rectangular. FIGS. 14 and 15 illustrate non-rectangular frames in accordance with other exemplary embodiments of the disclosure. FIG. 14 illustrates a gable frame 24*a*. FIG. 15 illustrates a radius frame 24*b*. In both FIGS. 14 and 15, the frame preferably is constructed of rails joined at their ends, such as plastic rails welded at their ends. The window units for frames 24*a* and 24*b* typically can comprise a single non-movable sash.

Figure 16:
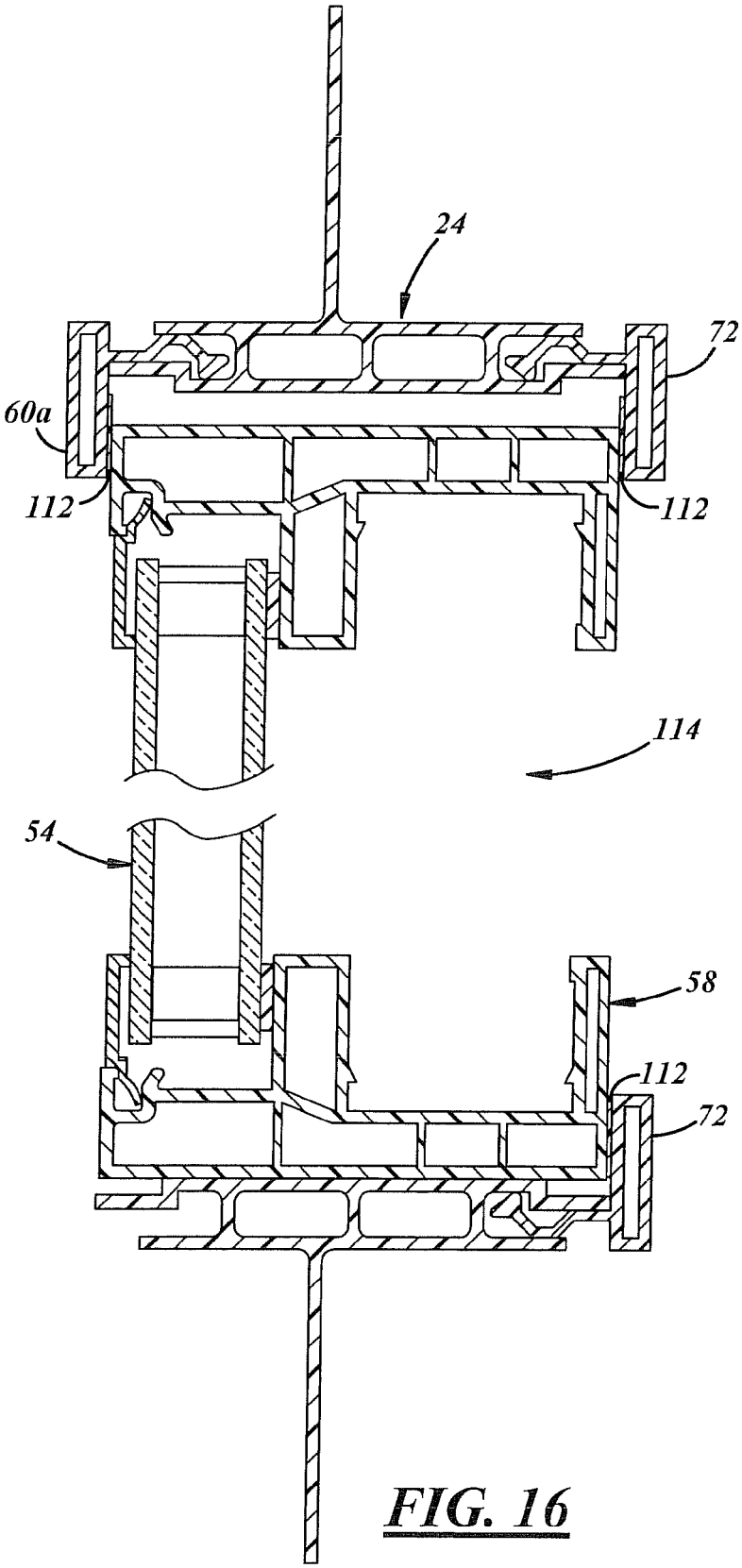
FIG. 16 is a sectional view of a window system similar to that in FIG. 2.

FIG. 16 illustrates a window system 114 that is similar in many respects to the window system 20 in FIG. 2. Window unit frame 58 is retained in frame 24 by retainers 60*a* and 72. Double-sided structural tape 112 can be disposed between retainers 60*a*, 72 and frame 58.

Figure 17:
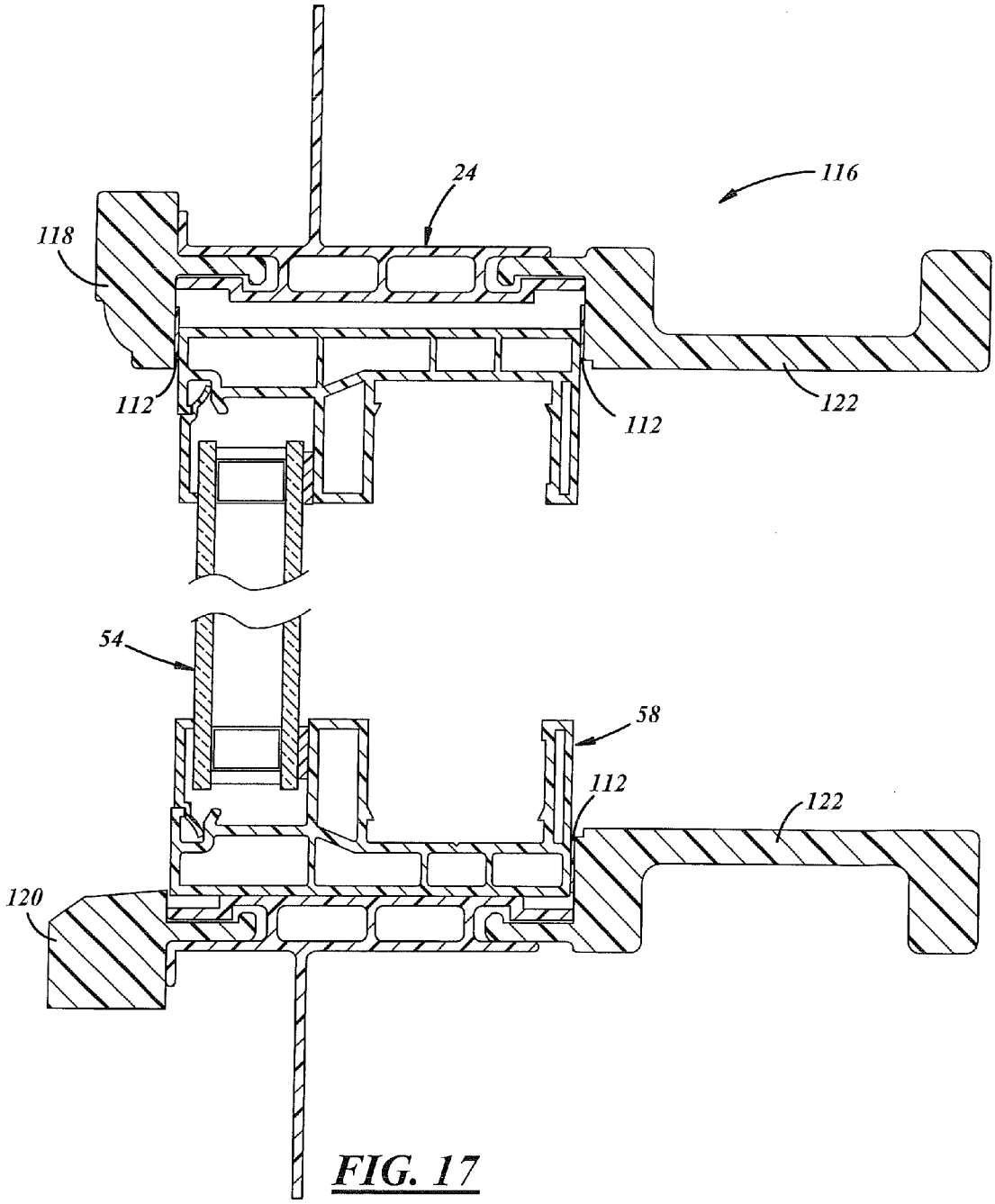
FIGS. 17-19 are sectional views of modifications to the system of FIG. 16.

FIG. 17 illustrates a window system 116 having decoratively contoured exterior retainers 118, 120. The interior retainers are in the form of interior jamb liners 122. This embodiment has the advantage that window unit 58 can be installed from the building interior.

Figure 18:
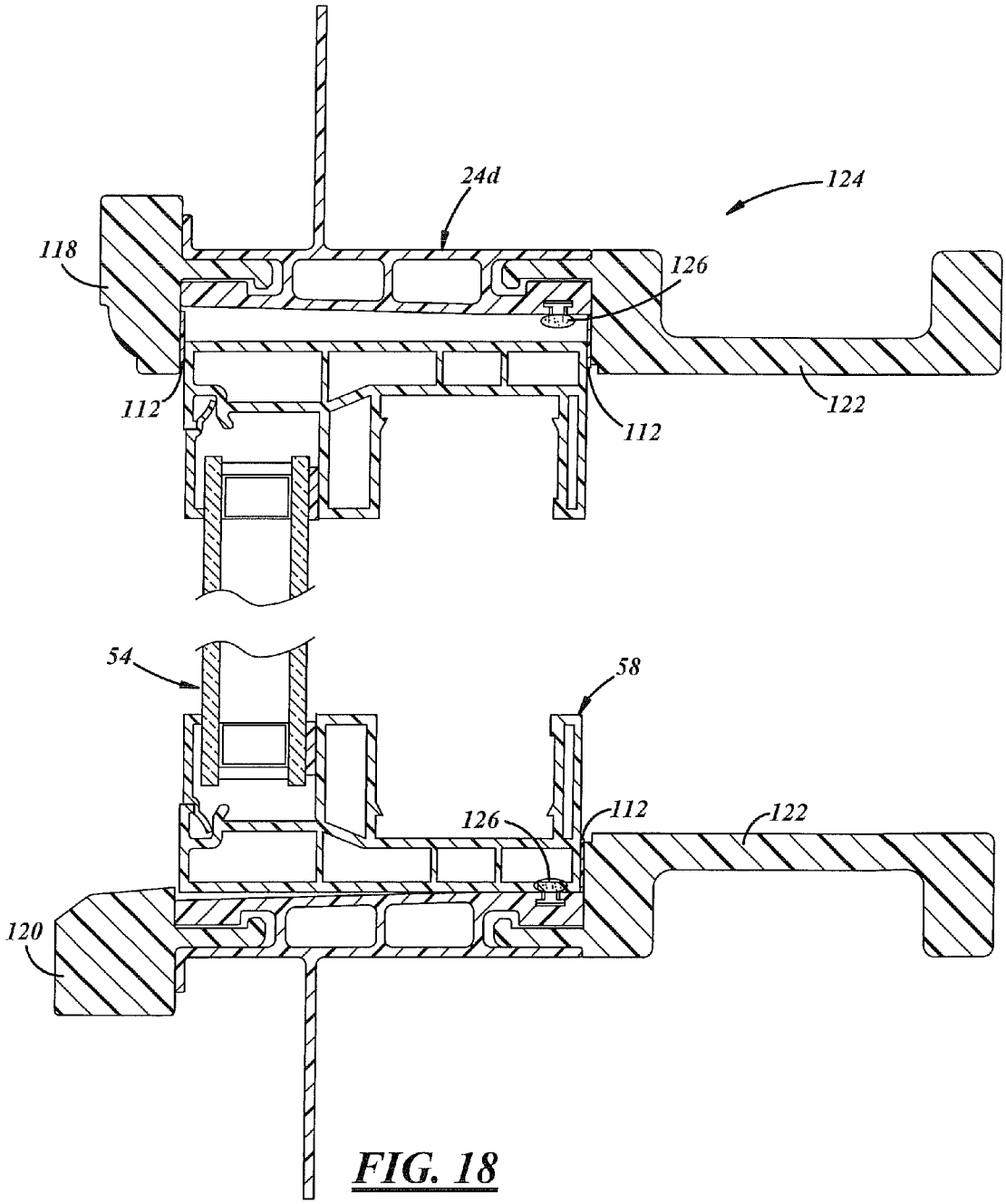

FIG. 18 illustrates a window system 124 that is similar in many respects to window system 116 in FIG. 17, except that the interior surfaces of frame 24*d* are at a slight angle to facilitate drainage. Frame 24*d* also carries bulb weatherstrips 126 to engage the exterior of window unit frame 58.

Figure 19:
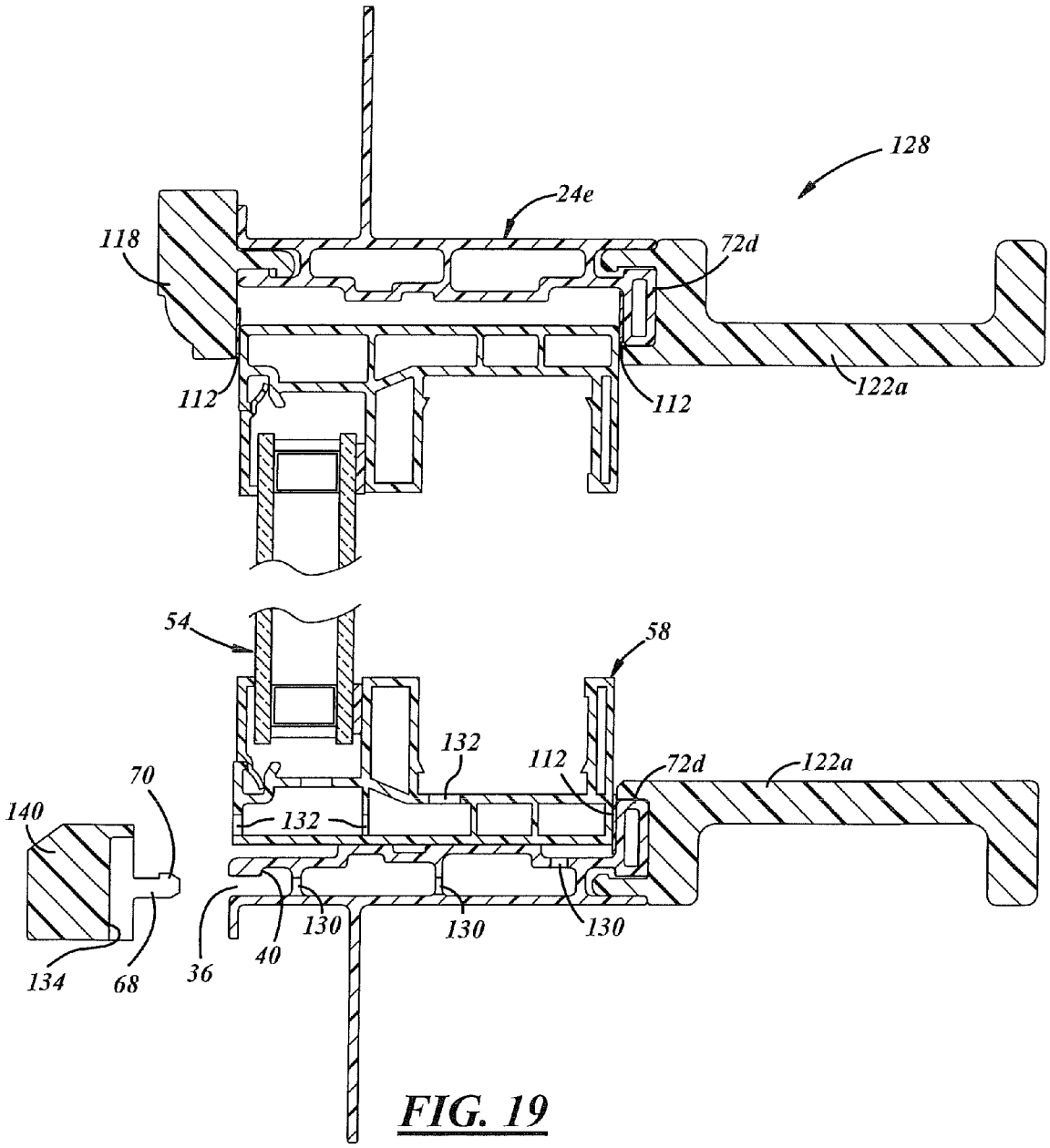

FIG. 19 illustrates a window system 128 in which interior retainers 72*d* are integral with frame 24*e*. Jamb liners 122*a* do not perform a retaining function in this embodiment. Weep openings 130 are drilled or otherwise formed in frame 24*e* to drain water to and through retainer 140. Weep openings 132 also can be formed in window frame 58 to drain water to and through retainer 140. Double-sided structural tape 112 can be disposed between retainer 118 and unit frame 58 to help hold retainer 118 in place. Double-sided structural tape 112 between unit frame 58 and frame 24*e* helps hold frame 58 in place.

Figure 12:
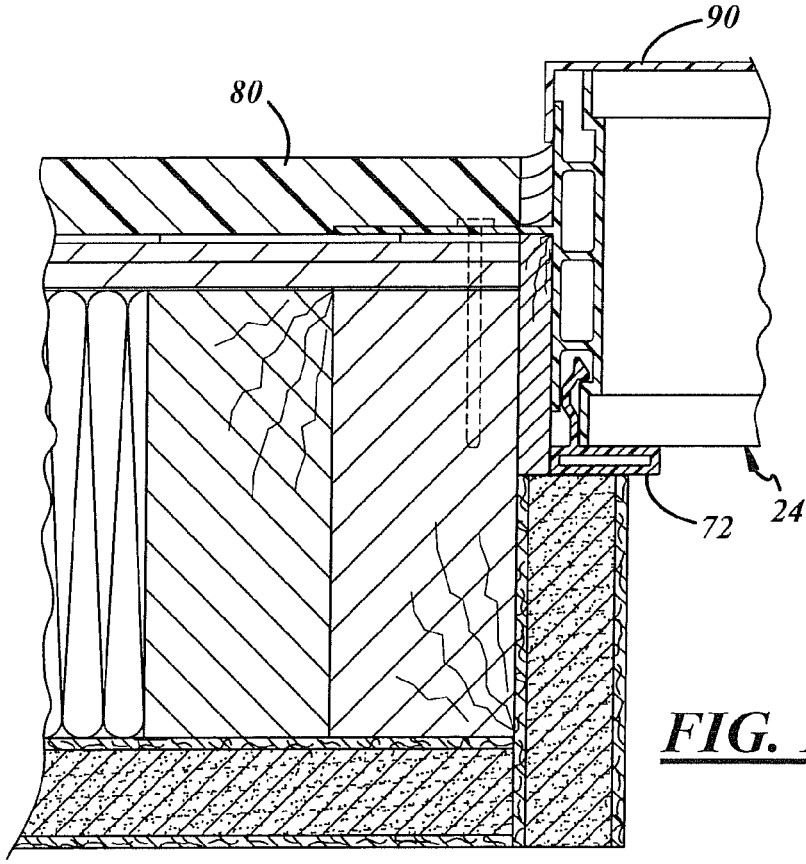

FIGS. 20-22 illustrate a modification to the embodiment of FIGS. 10-12, in which cover 90*a* has flanges 68 that terminate in barbs 70 for snap-retention within channel 36 in frame 24. Cover 90*a* is retained in frame 24 until the final stage of construction, at which point cover 90*a* is removed, the window unit is installed and the retainers are positioned to retain the window unit in the frame.

Figure 23:
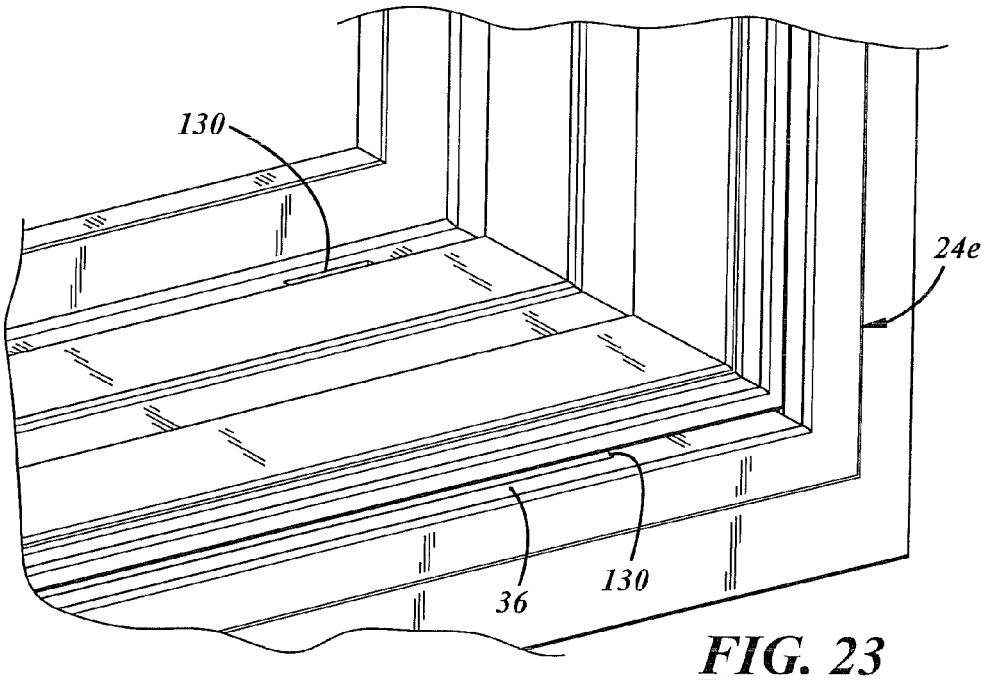
FIGS. 23-27 are fragmentary perspective views of portions of the window system illustrated in FIG. 19.
Figure 24:
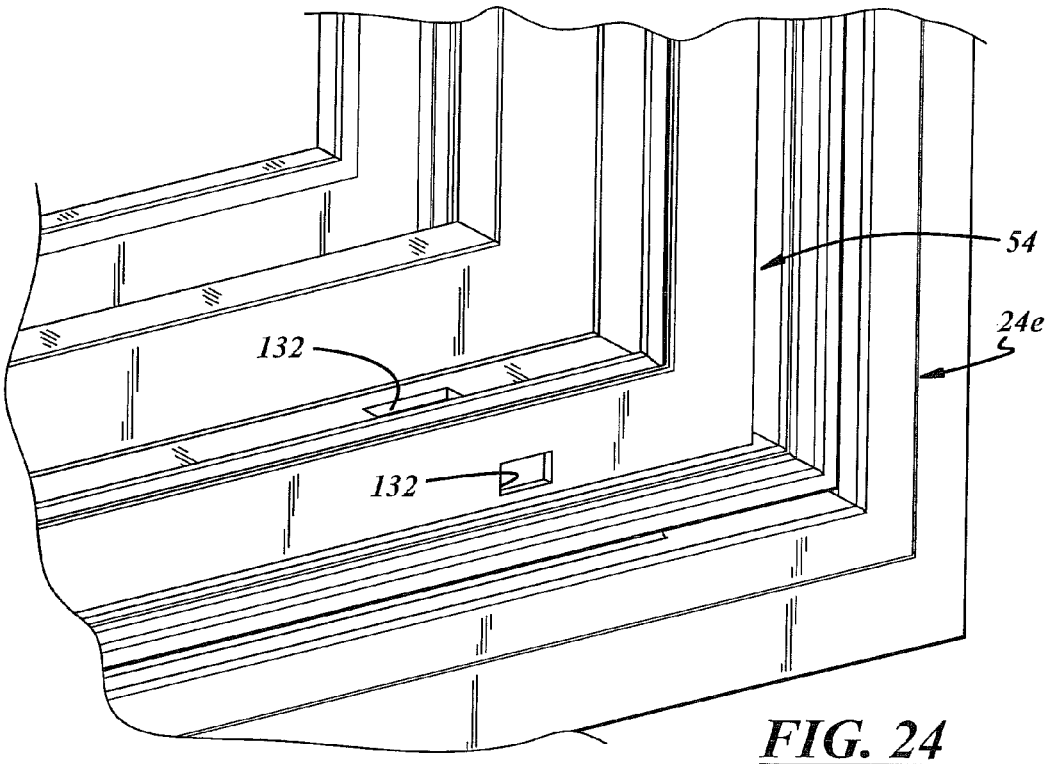
Figure 25:
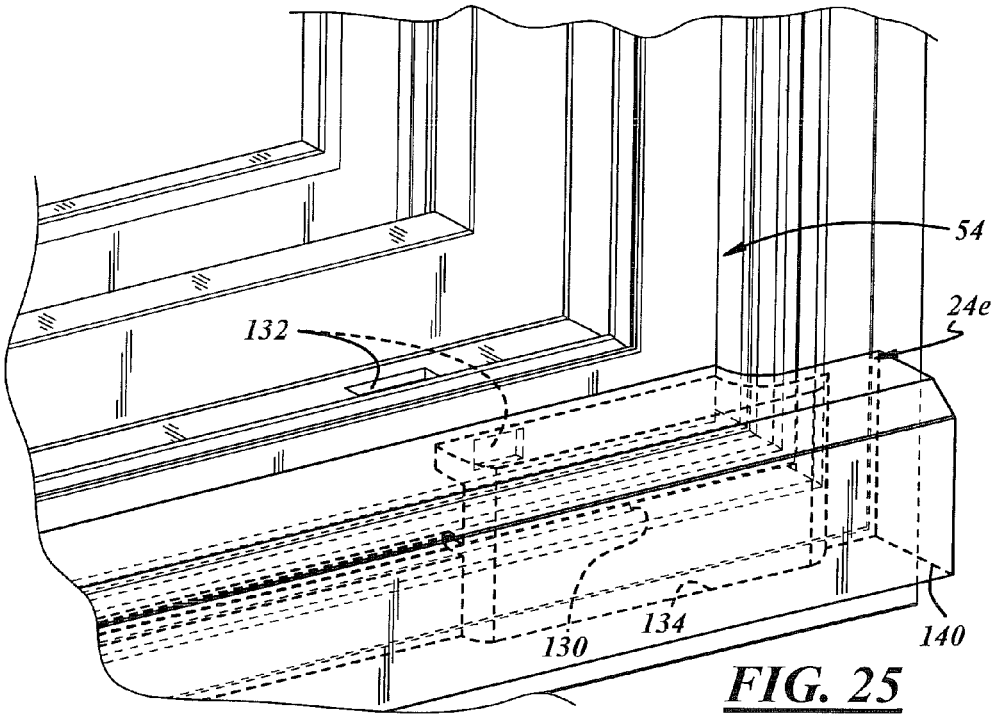
Figure 26:
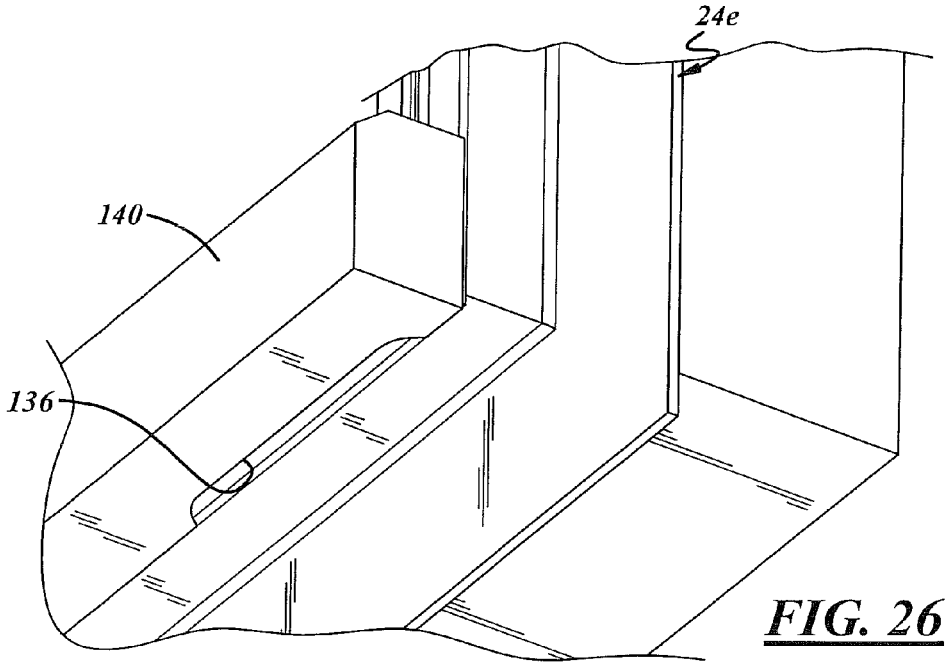
Figure 27:
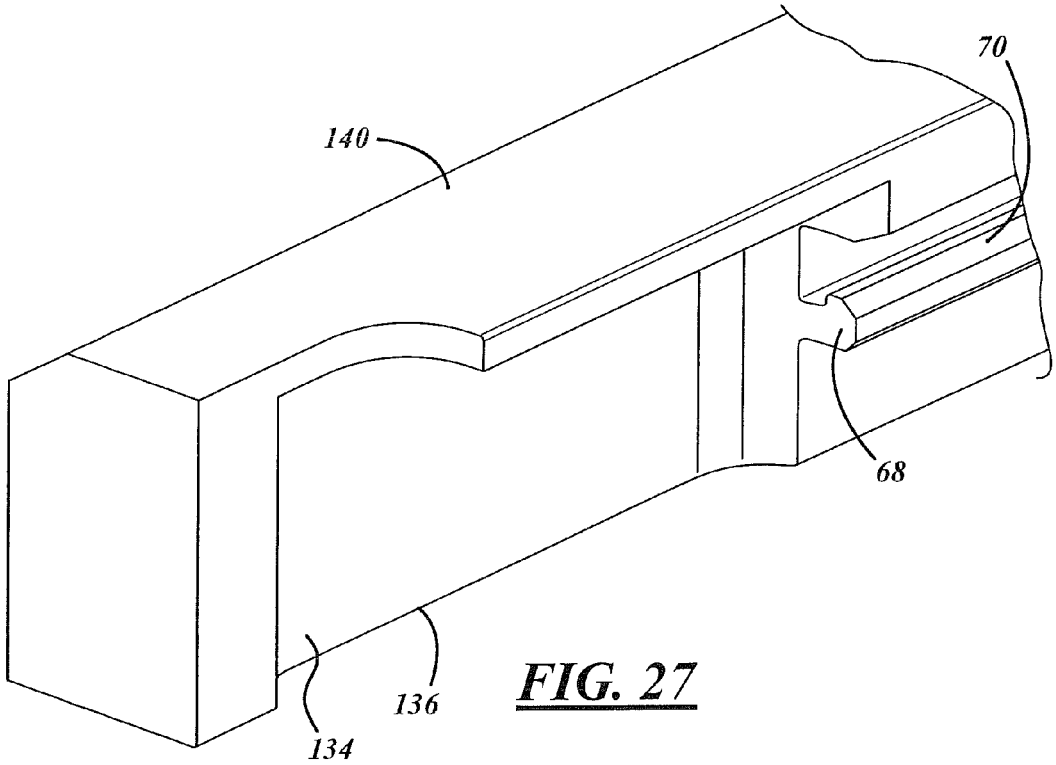

FIGS. 23-27 illustrate the embodiment of FIG. 19 in detail, particularly relating to the weep openings in the various elements for draining water away from the window unit and the window frame to the exterior of the building. FIGS. 19 and 23 illustrate frame 24*e* with weep openings 130. These weep openings extend to and along the bottom surface of frame 24*e*, and open into the slot or channel 36 in the bottom frame rail. Window unit 54 has weep openings 132 (FIGS. 24-25) that open to the exterior of the window system. Lower retainer 140 has an interior pocket 134 that aligns in assembly (FIG. 25) over weep opening 132 in window unit 54 and over weep opening 130 in slot 36 of frame 24*e*. Pocket 134 opens at 136 (FIG. 26) at the lower edge of the retainer to drain water that flows to pocket 134 from weep opening 132 and/or weep opening 130, so that water draining from frame 24*e* and window unit 54 freely flows by gravity through retainer 140.

Figure 28:
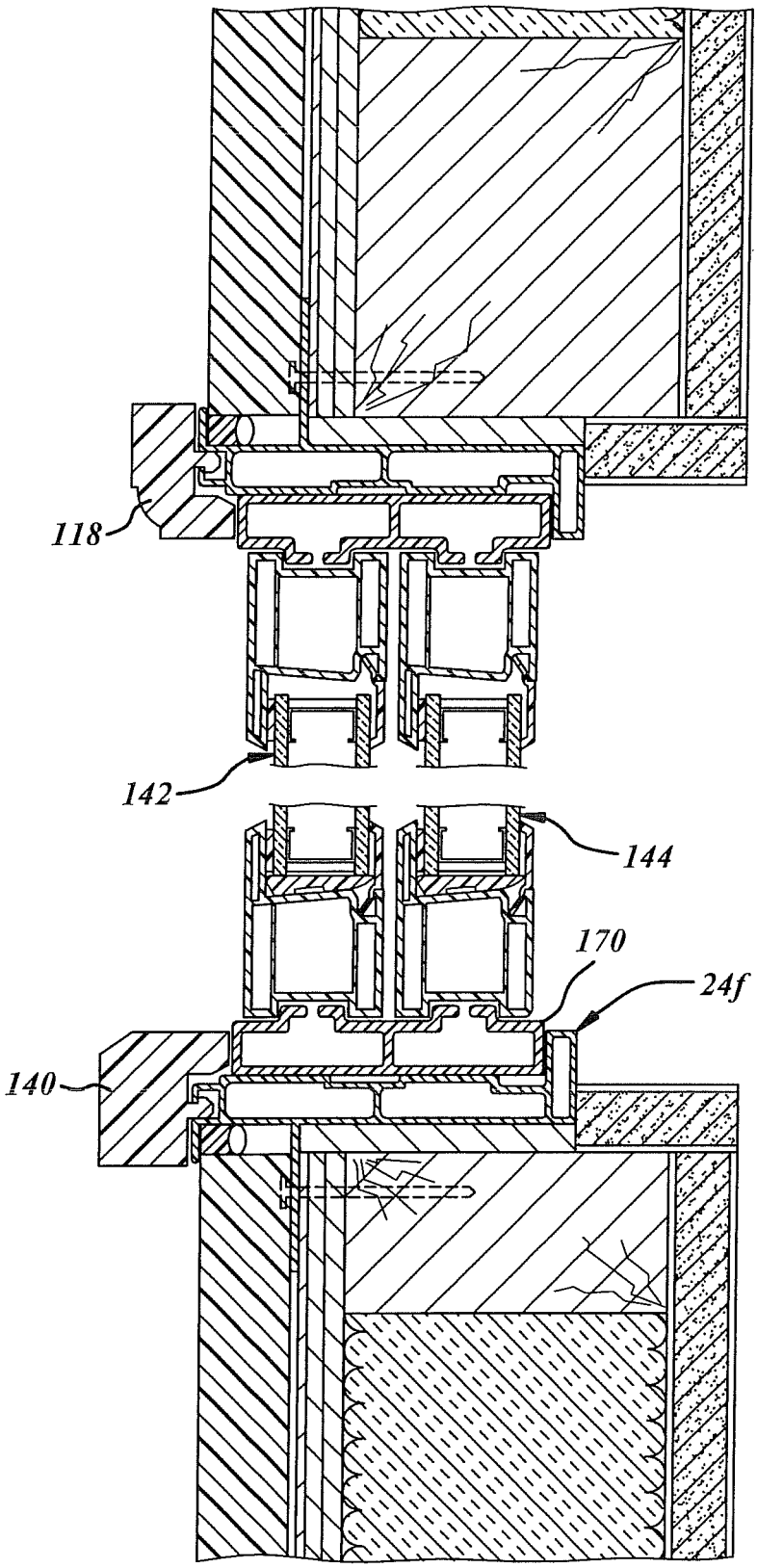
FIG. 28 is a sectional view that illustrates a further embodiment of the disclosure.

FIG. 28 illustrates a window system in which the window sashes 142, 144 are attached laterally to frame 24*f* by means of a mounting track 170.

Figure 29:
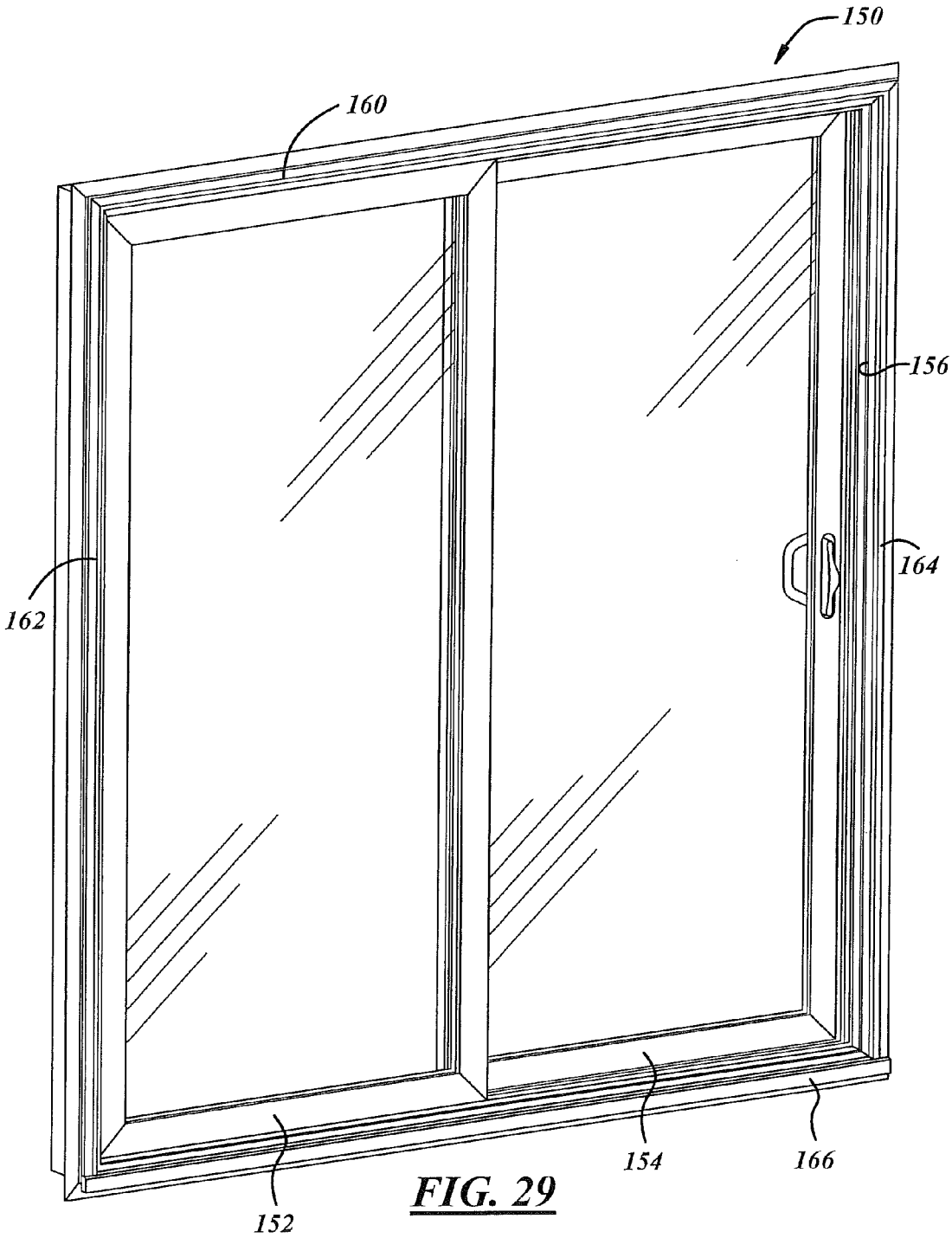
FIG. 29 is a perspective view that illustrates an embodiment of the disclosure in a sliding door system.

The principles of the present disclosure, illustrated by way of example in FIGS. 1-28 in conjunction with window systems, apply equally as well to door systems, particularly sliding door systems. FIG. 29 illustrates in an exemplary sliding door system 150 as including a fixed panel 152 and a sliding panel 154. The door panels are mounted in a frame 156 and secured by retainer 160, 162, 164, 166. Frame 156 and lower unit 166 preferably include weep draining functions of the type illustrated in FIGS. 19 and 23-27, and discussed above.

There thus has been disclosed a window or door system that fully satisfies all of the objects and aims previously set forth. The window or door system has been disclosed in conjunction with several exemplary embodiments, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A window or door system that includes:

a window or door system frame adapted to be received within a window or door opening and including an outward extending flange for securement to a building wall and a window or door unit opening defined by planar surfaces of said frame, a window or door unit including at least one sash preassembled to a window or door unit frame slidably received within said planar surfaces of said window or door unit opening of said window or door system frame, wherein either said window or door system frame or said window or door unit frame has an outward opening in said system frame or said unit frame, and a retainer received by interference fit in said opening in either said window or door system frame or said window or door unit frame, said retainer having a portion that extends to engage the other of said window or door system frame and said window or door unit frame and hold said window or door unit on said window or door system frame, wherein said window or door system frame has outward openings on both interior and exterior sides of said window or door system frame, and wherein said retainer is received by snap fit in said outward opening on said interior side and another retainer is received by snap fit in said outward opening on said exterior side to hold said window or door unit within said window or door system frame.

2. The system set forth in claim 1 wherein said retainer is linear and extends along adjacent edges of said window or door system frame and said window unit.

3. The system set forth in claim 1 wherein said retainer is received by snap fit on said window or door system frame or said window or door unit.

4. The system set forth in claim 1 wherein said retainer is removably received in said opening to permit removal of said window or door unit from said window or door system frame.

5. The system set forth in claim 1 wherein said outward opening has an internal shoulder and said retainer has a flange with a barb for extending into said opening, engaging said shoulder and holding said retainer within said opening.

6. The system set forth in claim 1 wherein said window or door system frame comprises a plurality of frame rails of plastic, wood, aluminum, fiberglass or vinyl construction.

7. The system set forth in claim 6 wherein said window or door system frame rails are of plastic regrind construction.

8. The system set forth in claim 1 wherein said window or door system frame is of rigid plastic construction.

9. The system set forth in claim 1 including a cover removably received on said window or door system frame at least prior to installation of said window unit into said window or door system frame.

10. The system set forth in claim 9 wherein said cover is of translucent or transparent plastic construction.

11. The window or door system of claim 1, wherein said at least one sash includes a single non-movable sash or multiple sashes including at least one movable sash.

12. The window or door system of claim 1 wherein said window or door unit frame is slidably received along an axis of said window or door unit opening of said window or door system frame, and said at least one sash of said window or door unit extends transversely with respect to said axis.

13. The window or door system of claim 12 wherein said at least one sash of said window or door unit is slidably received perpendicular with respect to said axis.

14. A window or door system that includes:

a window or door system frame adapted to be received within a window or door opening and including an outward extending flange for securement to a building wall and a window or door unit opening defined by planar surfaces of said frame, a window or door unit including at least one sash preassembled to a window or door unit frame slidably received within said planar surfaces of said window or door unit opening of said window or door system frame, wherein either said window or door system frame or said window or door unit frame has an outward opening in said system frame or said unit frame, and a retainer received by interference fit in said opening in either said window or door system frame or said window or door unit frame, said retainer having a portion that extends to engage the other of said window or door system frame and said window or door unit frame and hold said window or door unit on said window or door system frame, wherein said outward opening includes slots extending along at least three sides of said window or door system frame and retainers received in said slots along said at least three sides of said window or door system frame, wherein said window or door system frame has a lower rail with at least one weep opening to permit drainage of water and opening into said slot, wherein said retainer has a passage that aligns with said weep opening to permit drainage of water through said retainer.

15. A window or door system that includes:

a rigid window or door system frame adapted to be received within a window or door opening and having an outward extending flange for securement to a building wall, a window or door unit opening defined by planar surfaces of said system frame, and at least one outwardly opening slot in said system frame, a window or door unit including at least one sash preassembled to a window or door unit frame slidably received within said planar surfaces of said window or door unit opening of said window or door system frame, and a retainer separate from said window or door system frame and said window or door unit, said retainer being received by snap fit in said slot and having a portion that extends to engage said window or door unit to secure said window or door unit within said window or door system frame, wherein said window or door system frame has outwardly opening slots on both interior and exterior sides of said window or door system frame, and wherein said retainer is received by snap fit in said outwardly opening slot on said interior side and another retainer is received by snap fit in said outwardly opening slot on said exterior side to engage and hold said window or door unit within said window or door system frame.

16. The system set forth in claim 15 wherein said window or door system frame has at least one straight side, and wherein said retainer is linear and extends along said at least one straight side of said window or door system frame.

17. The system set forth in claim 16 wherein said outwardly opening slot extends along at least three sides of said window or door system frame, and wherein retainers are received in said slots along said three sides of said window or door system frame.

18. The system set forth in claim 15 wherein said retainer is removably received in said slot to permit removal of said window frame assembly from said window or door system frame.

19. The system set forth in claim 15 including a cover adapted to be removably received on said window or door system frame at least prior to installation of said window unit into said window or door system frame.

20. The system set forth in claim 19 wherein said cover is of translucent or transparent plastic construction.

21. The system set forth in claim 15 wherein said outwardly opening slot has an internal shoulder and said retainer has a flange with a barb for engaging said shoulder and holding said retainer within said slot.

22. The system set forth in claim 15 wherein said window or door system frame comprises a plurality of plastic, wood, aluminum, fiberglass or vinyl construction frame rails joined end-to-end.

23. The system set forth in claim 22 wherein said frame rails are of plastic regrind construction.

24. The window or door system of claim 15, wherein said at least one sash includes a single non-movable sash or multiple sashes including at least one movable sash.

25. A window or door system that includes:

a rigid window or door system frame adapted to be received within a window or door opening and having an outward extending flange for securement to a building wall, a window or door unit opening defined by planar surfaces of said system frame, and at least one outwardly opening slot in said system frame, a window or door unit including at least one sash preassembled to a window or door unit frame slidably received within said planar surfaces of said window or door unit opening of said window or door system frame, and a retainer separate from said window or door system frame and said window or door unit, said retainer being received by snap fit in said slot and having a portion that extends to engage said window or door unit to secure said window or door unit within said window or door system frame, wherein said window or door system frame has a lower rail with at least one weep opening to permit drainage of water and opening into said slot, wherein said retainer has a passage that aligns with said weep opening to permit drainage of water through said retainer.

26. A window or door system frame that includes at least one frame rail having an outward extending flange for securement to a building wall and defining a window or door unit opening defined by planar surfaces of said system frame for slidable receipt of a window or door unit frame of a window or door unit, said rail having an outwardly opening slot in said rail for receiving a retainer to hold the window or door unit within said window or door system frame, wherein said window or door system frame has outwardly opening slots on both interior and exterior sides of said window or door system frame.

27. The window or door system frame set forth in claim 26 wherein said window or door system frame is rectangular and said outwardly opening slot extends along at least three sides of said window or door system frame.

28. The window or door system frame set forth in claim 26 wherein said slot has an internal shoulder for engagement by said retainer.

29. The window or door system frame set forth in claim 26 wherein said window or door system frame comprises a plurality of frame rails of plastic, wood, aluminum, fiberglass or vinyl construction.

30. The window or door system frame set forth in claim 29 wherein said frame rails are of plastic regrind construction.

31. The window or door system frame set forth in claim 26 wherein said window or door system frame is of rigid plastic construction.

32. The window or door system frame set forth in claim 26 including a cover removably received on said window or door system frame at least prior to installation of said window unit into said window or door system frame.

33. The window or door system frame set forth in claim 32 wherein said cover is of translucent or transparent plastic construction.

34. A method of assembling a window or door to a surrounding support structure such as a building wall, which includes the steps of:

(a) mounting a window or door system frame within a window or door opening in the support structure, including securing an outward extending flange of the system frame to the building wall, (b) temporarily mounting a cover over said system frame temporarily to close the window or door opening, (c) subsequently removing said cover and positioning a window or door unit within said system frame by sliding said window or door unit along planar surfaces that define an opening of said system frame, and (d) securing said window or door unit to said system frame by mounting at least one retainer by interference fit on said system frame or said window or door unit such that said retainer has a portion that extends to engage the other of said system frame and said window or door unit and holds said window or door unit on said system frame.

* * * * *